United States Patent [19]

Maddux et al.

[11] Patent Number: 4,697,592

[45] Date of Patent: Oct. 6, 1987

[54] SUPPORT SYSTEM

[76] Inventors: Irene H. Maddux; Gordon T. Maddux, both of 1220 Flatau Dr., Prescott, Ariz. 86303

[21] Appl. No.: 3,100

[22] Filed: Jan. 14, 1987

[51] Int. Cl.[4] ..... A41C 1/08

[52] U.S. Cl. ..... 450/155

[58] Field of Search ..... 128/579, 546, 518, 544

[56] References Cited

U.S. PATENT DOCUMENTS 3,273,563 9/1966 Bonange ..... 128/579 R 4,557,268 12/1985 Maddux et al. ..... 128/579

*Primary Examiner*—Doris L. Troutman

*Attorney, Agent, or Firm*—Nilsson, Robbins, Dalgarn Berliner, Carson & Wurst

[57] ABSTRACT

A garment for wear to provide both lower back and abdominal support and particularly adapted for wear by a pregnant woman. The garment is a panty having a body with a velcro tab sewn to the rear portion above the buttocks for removably affixing a first continuous belt thereto to encircle the wearer around the lower portion of the abdomen and above the buttocks of the wearer. The first belt includes a fastening means providing adjustment of tension and to accommodate growth. The first belt includes a complimentary velcro tab affixed centrally thereof for attaching the first belt includes a complimentary velcro tab affixed centrally thereof for attaching the first belt to the panty. A second belt is secured permanently to the first belt and includes distal portion adapted for attachment to the first belt to provide lower back support.

6 Claims, 5 Drawing Figures

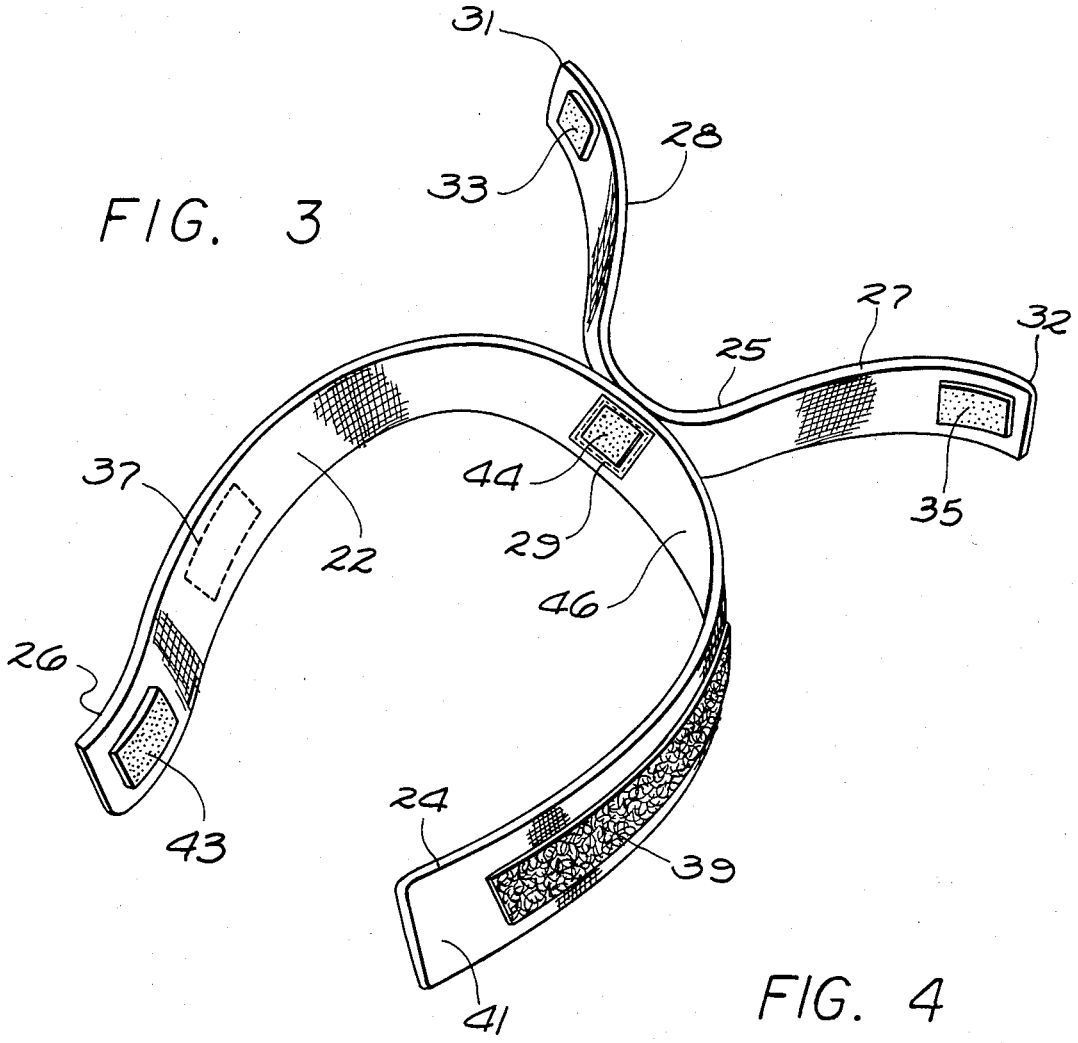
FIG. 3
FIG. 4
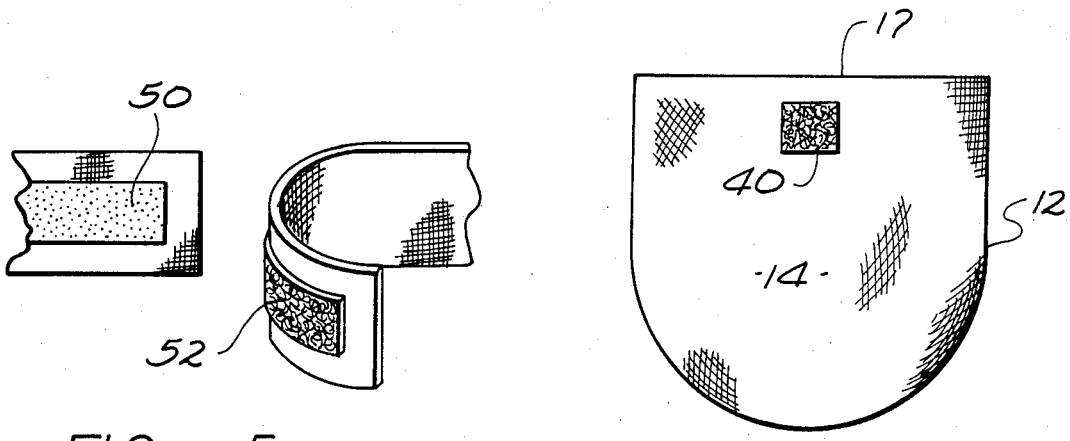
FIG. 5

SUPPORT SYSTEM

BACKGROUND OF THE INVENTION

1. Field of the Invention

This invention relates generally to support-providing wearing apparel and more specifically to such apparel in the form of panty more specifically adapted for pregnant women.

2. Prior Art

It has been common practice for women to wear girdles or other support-type structure separately and together with panties during pregnancy and otherwise. Such prior art structures, however, are often uncomfortable and are difficult and burdensome to use. Those prior art devices which do provide comfort for the wearer do not provide adjustability of the garment to accommodate physical changes as pregnancy progresses. The best prior art know to Applicant is shown in U.S. Pat. Nos. 2,711,542; 2,763,009; 2,863,152; 2,981,258; 3,931,816; 4,325,379; 4,494,546 and 4,557,268. Of these prior art patents referred to the most pertinent is applicant's Pat. No. 4,557,268. Disclosed therein is a panty support garment having a first body encircling belt permanently affixed thereto with a seoond belt also permanently affixed thereto at a point displaoed from the fixation point of the first belt. Although this support garment works quite well it was found that a superior garment was achieved by securing each of the belts at the same position on the garment and further that by providing the capability of detaching the belts from the garment, cleaning of the garment is facilitated.

SUMMARY OF THE INVENTION

A support system including a panty having a body 33 and 35 of resilient material having a width of at least 1½ inches disposed to fit at the front portion of the body of the panty beneath the belly of the wearer. First fastening means secured to said body of said panty and to said first band for detachably securing said first band to said body and second fastening means attached to the ends of said first band for adjustably securing the band around the wearers body. A second belt-like member permanently secured to said first band for providing lower back support to the wearer.

BRIEF DESCRIPTION OF THE DRAWINGS

FIG. 3 is a perspective view showing the construction of the belt;

FIG. 4 is a rear view of the panty illustrating the manner in which the belt is secured to the panty; and FIG. 5 is a partial fragmentary view illustrating in further detail one form of fastening means for use with the belt.

DESCRIPTION OF THE PREFERRED EMBODIMENT

Figure 1:
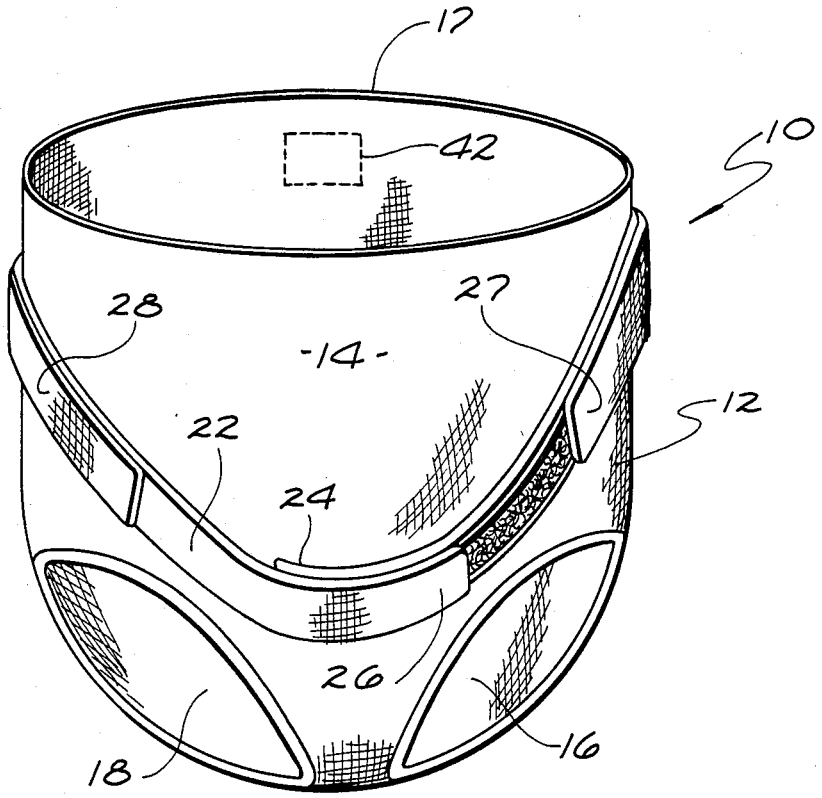
FIG. 1 is a perspective view from the front of a garment constructed in accordance with the present invention.

As shown in the drawing, there is provided a garment 10 which includes a panty 12 having a body portion 14 with appropriate leg openings 16 and 18 therein. The body 14 is formed of resilient material to assist in supporting the wearer. The material may have a substantial stretch in the vertical direction as viewed in FIG. 1 but less in the horizontal direction. The preferred material from which the body 14 is formed is identified as Spandex Lycra knit and functions to snugly fit upon the body of the wearer. It will, however, be recognized by those skilled in the art that other stretchable fabrics may function equally well.

Figure 2:
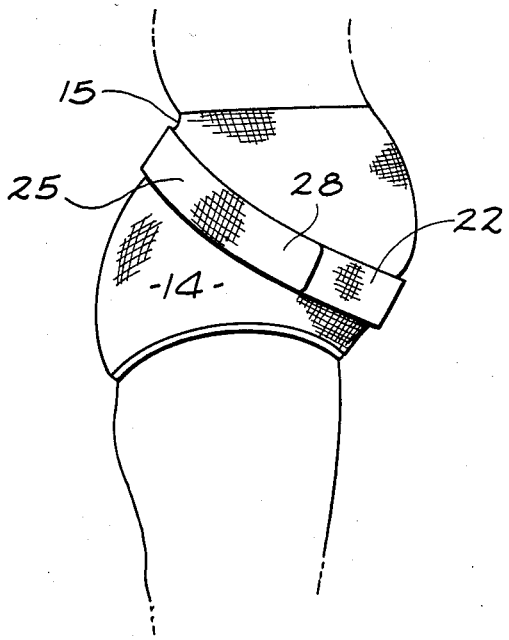
FIG. 2 is a side view of the garment in place upon a wearer.

A first band or belt 22 is detachably secured to the body 14 at the back portion 15 thereof below the top edge 17. The ends 24 and 26 of the belt 22 are provided with fastening means so that the belt may be adjusted about the body of the wearer. As will be appreciated particularly from FIG. 2, the belt 22 encircles the body of the user and extends from a position below the top of edge 17 of the body 14 and thus above the buttocks and to the lower part of the abdomen of the wearer. In addition thereto the fastening means 39 and 43 affixed to the ends 24 and 26 of the belt 22 is adjustable so that the tension which is applied by the belt to the body of the wearer may be adjusted depending on a number of facts such as comfort to the wearer, if the wearer is a pregnant woman, to the growth of the fetus and the like. The belt 25 is shorter than the belt 22 with the ends 31 and 32 terminating along the sides of the belt 22.

A second band or belt-like member 25 having sections 27 and 28 is permanently affixed to the first belt 22 as shown by the stitching at 29 and is positioned so that the top edge thereof is substantially at the same level as the top edge of the belt 22. The ends 31 and 32 of the belt 25 are provided for fastening means 33 and 35 adapted so that the belt 25 may be adjusted to provide the wearer with the desired lower back support. Fastening means 33 and 35 are affixed as by stitching to the ends 31 and 32 of the belt 25 and are designed so as to secure or anchor the ends 31 and 32 to the complimentary fasteners 37 and 39 affixed to the outer surface 41 of the belt 22. It will be noted that the fastener means 39 cooperates with the complimentary fasteners 35 and 43 to secure the ends 27 and 26 of the belts 25 and 22 respectively.

The permanently secured together belts 22 and 25 are detachably secured to the panty 12 by a fastener means 40 permanently secured to the outer surface of the body 14 below the top 17 thereof. The fastener 40 is preferably secured to the panty 12 by stitching 42. A complimentary fastener means 44 is permanently secured by the stitching 29 to the inner surface 46 of the first belt 22 at substantially the center thereof. The complimentary fasteners 40 and 44 are preferably the same size. Through the utilization of the fasteners 40 and 44, the belt assembly 22–25 may be removed or attached to the panty 12 to complete the support garment as desired. Those skilled in the art will recognize that this feature allows a user to attach the belt assembly 22–25 to a plurality of different panties as opposed to having the belts permanently attached to the panty as in the prior art. Furthermore, this feature allows the user to easily separate the belt assembly from the panty for cleaning. The belts 22 and 25 are constructed or resiliently deformable material, preferably elastic, which has a width dimension of at least 1½ inches and preferably 3 inches wide. It has been found that width less than 1½ inches tends to cut into the body of the wearer, becoming uncomfortable after a relatively short time.

As will be appreciated by those skilled in the art, each of the belts 22 and 25 is preferably constructed from resilient deformable material such as elastic so that the tension and support provided by each of the belts independently and together may be adjusted as desired under the varying circumstances of use and wear. It will also be appreciated by those skilled in the art that by positioning the belts at the rear portion of the body 14 of the garment 10 to extend from substantially the waistline to a point displaced therefrom downwardly that substantial support to the lower back is provided to thereby alleviate low back fatigue and pain which is often associated with those individuals carrying a substantial amount of weight in the abdomen area. Particularly, the garment constructed in accordance with the present invention provides such support for pregnant women and all persons having substantial overweight conditions.

As above stated, the garment 10 is particularly adapted for use by pregnant women and has been found to be surprisingly useful to pregnant women involved in various athletic activities. The use of the garment constructed in accordance with the present invention provides substantial support for the fetus because the belt 22 is adapted to fit about the lower portion of the abdomen as is more clearly shown in FIG. 2. As is also shown, the belt totally encircles the body 14 of the user. Through the utilization of the fastening means 39 and 43, the ends 24 and 26 of the belt 22 can be secured in various positions to provide the desired amount of force to properly support the fetus. It will further be recognized that as the abdomen extends during the latter stages of pregnancy, the belt may be adjusted to accommodate the same. These features also tend to decrease the stretch marks on the abdomen of the mother.

As is shown in FIG. 5, the ends 24, 26, 31 and 32 of the belt assembly 22–25 have fastening means such as shown at 50 and 52 affixed to opposed, overlapping faces thereof. In a preferred embodiment as illustrated in the drawings, the fastening means 50 and 52 are made of a pair of self-fastening complementary tapes including hook-like projections and a fuzz-like matt. Thus, upon pressing these two opposed faces together they become fastened. This type of fastening arrangement is known in the market under the name "VELCRO" and may be easily adjusted by the wearer as is well known.

Through utilization of the support garment as above described, excellent support is provided the wearer for the lower back as well as the abdomen. Surprisingly by securing the two belts 22 and 25, preferably of the same width, together substantially at the center of each and by securing the ends 31 and 32 of the belt 25 to the outer surface of the belt 22 on opposite sides of the wearer, forces are generated in opposite directions providing a firm, well disposed support. When the belt 22 is first fastened into position, after being attached to the panty, uplifting support is provided to the abdomen. Thereafter as the sections 27 and 28 of the belt 25 are pulled forwardly, forces are generated in a downward direction along the longitudinal axis of the belt 22. By then securing the ends 31 and 32 of the belt 25 to the fasteners 37 and 39 on the outer surface 41 of the belt 22, those forces are sustained to firmly surround the lower back and hold it securely in place. It should be noted that, unlike other support garments, the user can adjust both belts independently to obtain the desired support.

What is claimed is:

1. A support system to provide abdominal and back support to the body of a human being comprising:

a panty like garment having a body portion;

a first resiliently deformable body encircling band member;

a second resiliently deformable band member having a relaxed length substantially less than the relaxed length of said first band member, said first and second band members being permanently secured together at substantially the longitudinal axial midpoint of each;

first fastening means secured to said body of said panty and to said midpoint of said first band member for detachably securing said band members to said panty; and adjustable fastening means secured to opposite ends of each of said band means for adjustably fastening said band means about the body of a wearer.

2. The support system as defined in claim 1 wherein said adjustable fastening means on said second band member includes complementary fasteners disposed at opposite ends of said second band member and on a surface of said first band member opposed each end of said first band member.

3. The support system as defined in claim 2 wherein said first and second band members are elastic material having substantially identical width dimensions.

4. The support system as defined in claim 3 wherein said width dimension is at least $1\frac{1}{2}$ inches.

5. The support system as defined in claim 3 wherein said first band member is a continuous member with opposed overlapping ends thereof carrying said adjustable fastening means.

6. The support system as defined in claim 5 wherein said adjustable fastening means are Velcro fasteners.

* * * * *